United States Patent [19]

Borne

[11] 3,982,288

[45] Sept. 28, 1976

[54] NIGHT LIGHT TOILET SEAT

[76] Inventor: Mel Borne, P.O. Box 474, Palm City, Fla. 33490

[22] Filed: Apr. 10, 1975

[21] Appl. No.: 566,963

[52] U.S. Cl. ..... 4/237; 4/234
[51] Int. Cl.[2] ..... A47K 13/00
[58] Field of Search ..... 4/237, 236, 233, 234, 4/242, 1

[56] References Cited

UNITED STATES PATENTS

| | | | |
|---|---|---|---|
| 2,458,019 | 1/1949 | Niles | 4/233 |
| 2,460,543 | 2/1949 | Spierer | 4/233 |
| 2,616,097 | 11/1952 | Smith | 4/233 |

*Primary Examiner*—Henry K. Artis

[57] ABSTRACT

An improved toilet seat which additionally serves as a night light and which aids a person in finding a toilet seat in a darkened bathroom during a night time, the toilet seat being made of resins or plastics that is clear or colored-tinted and the toilet seat having a clear lucite rod cast within its center, one end of the lucite rod being aligned with an electric lamp stationarily supported and wherein the lamp light automatically goes out when the toilet seat is raised.

3 Claims, 4 Drawing Figures

Fig. 3
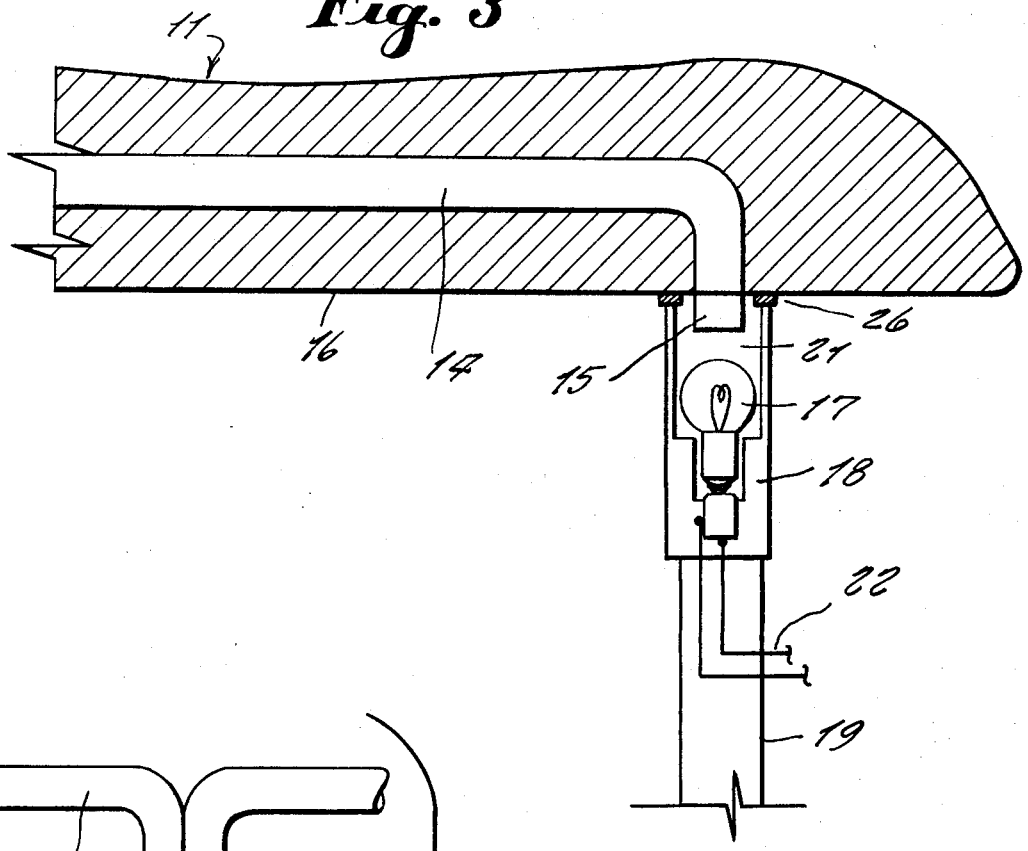
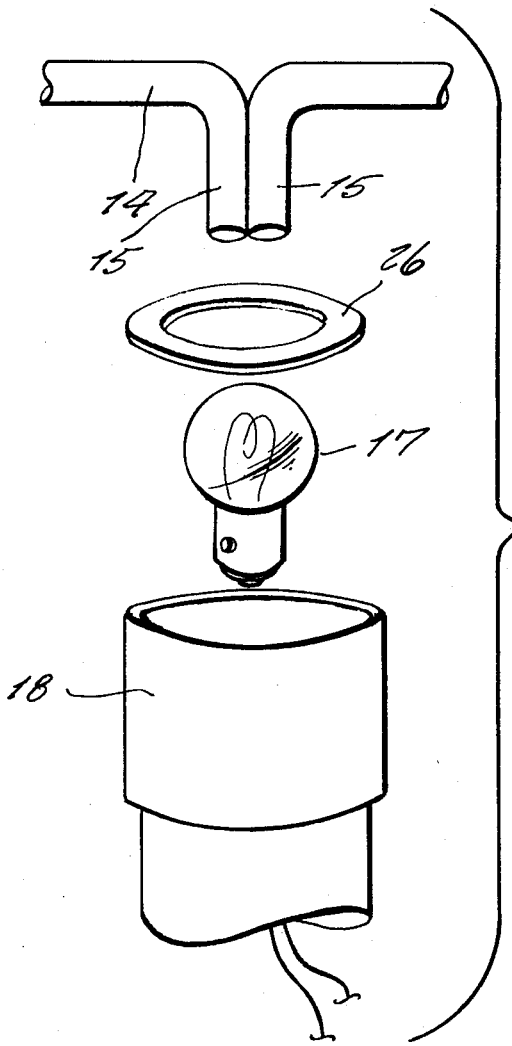
Fig. 4

NIGHT LIGHT TOILET SEAT

This invention relates generally to toilet seats.

A principal object of the present invention is to provide an improved toilet seat which incorporates means so that it serves also as a night light.

Another object of the present invention is to provide a night light toilet seat in which the intensity of the light from the toilet seat can be controlled.

Still another object is to provide a night light toilet seat wherein the toilet seat illumination is automatically shut off when the toilet seat is in a raised upwardly position.

Yet another object is to provide a night light toilet seat which by incorporating illumination will readily indicate to a person in a darkened bathroom at night when the toilet seat cover is down due to blocking out some of the light from the seat.

Other objects are to provide a night light toilet seat which is simple in design, inexpensive to manufacture, rugged in construction, easy to use and efficient in operation.

These and other objects will become readily evident upon a study of the following specification together with the accompanying drawing wherein.

FIG. 3 is an enlarged fragmentary cross-sectional view of the toilet seat together with a portion of the illuminating structure;

FIG. 4 is an exploded perspective view of a lamp unit components which comprise a portion of the present invention.

Figure 1:
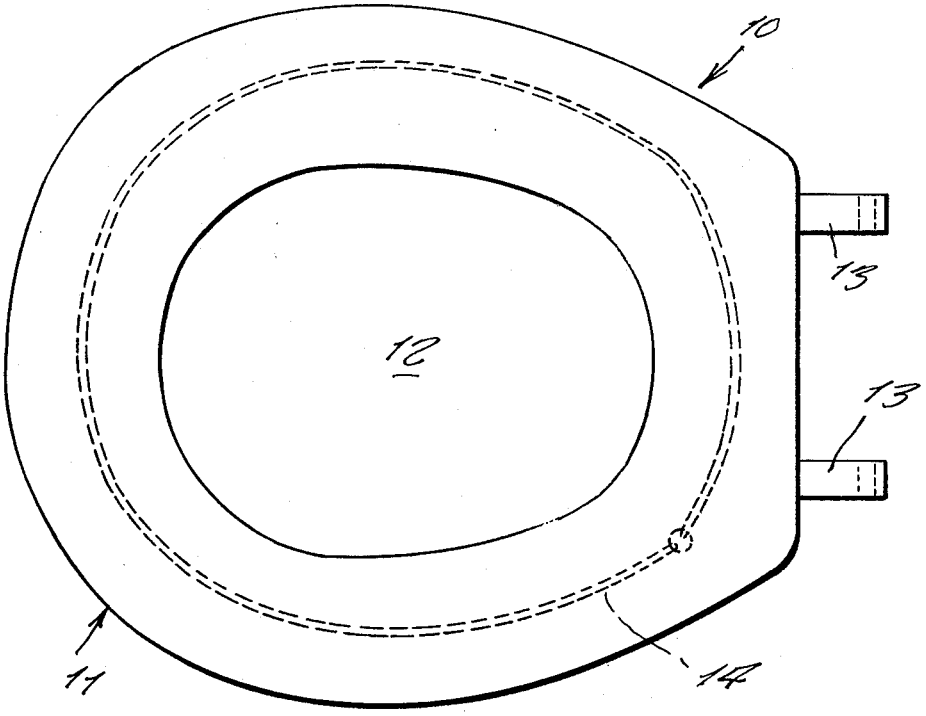
FIG. 1 is a top plan view of the night light toilet seat.

Referring now to the drawings in detail, the reference numeral 10 represents a night light toilet seat, according to the present invention, wherein there is a conventional shaped toilet seat member 11 around a central opening 12, the toilet seat being pivotable between a vertical non-use position and a horizontal use position upon a toilet bowl by means of hinged plates 13.

Figure 2:
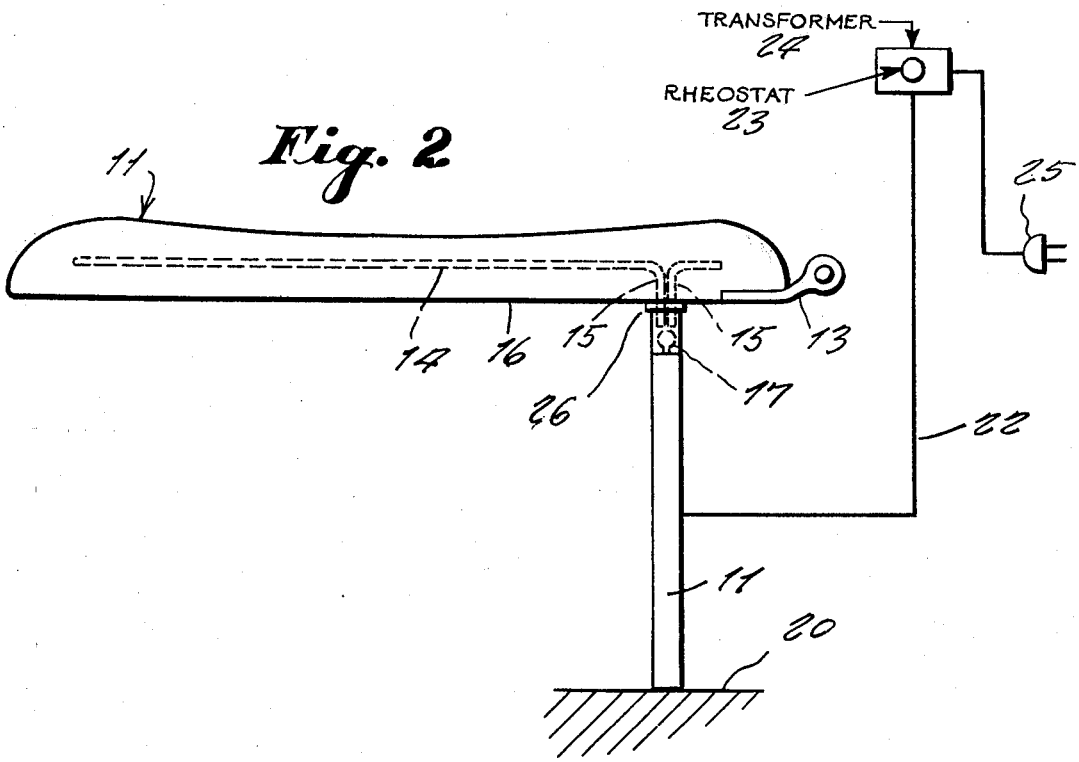
FIG. 2 is a side elevation view thereof shown together with an illumination system thereof.

In the present invention, the toilet seat member 11 is molded or cast from resins or plastics that are transparent or clear or which otherwise can be tinted in any color. Within a center of the toilet seat there is molded a clear lucite rod 14, the opposite ends 15 of the lucite rod extending outwardly of an underside 16 of the toilet seat and positioning against an electric lamp 17 when the toilet seat is in a horizontal utility position as shown in FIGS. 2 and 3. The entire surface of the lucite rod imbedded within the toilet seat is roughened so that light rays entering the end of the lucite rod will thus illuminate the entire resin or plastic of the toilet seat material.

The lamp 17 may be of a 12 volt D.C. electrical power that is equivalent to 10 candle power; and the lamp is fitted into a hard rubber socket 18 supported upon the upper end of a bracket 19 which at its lower end is supported upon a floor 20. The bracket 19 is stationary, and the hard rubber socket 18 includes a deep opening 21 within its upper end, the lamp 17 being located within a lower end of the opening while the upper end of the opening is adapted to receive the exposed ends 15 of the lucite rod. Thus the deeply set lamp within the interior of the socket 18 prevents light rays going in any other direction except upwardly toward the ends of the lucite rod. The socket 18 is understood to be of an opaque material so that the light rays do not pass therethrough.

The lamp 19 is within an electric circuit 22 that incorporates a rheostat 23, a transformer 24 and a plug 25 which is attachable to an electric power source. The upper edge of the socket 18 has a rubber gasket 26 of circular shape fitted thereupon so as to prevent stray light rays from escaping between the upper edge of the socket and the underside of the toilet seat, as is clearly shown in FIG. 3.

According to the invention, the intensity of the light can be controlled by means of a rheostat control unit. Also a secondary means such as the bulb being powered by 1½ volt dry cell batteries located in series can form any voltage as required. Thus an alternate means can be used as a power source instead of the conventional 110 volts of a household electric supply.

The toilet seat cover has no lighting apparatus and can be cast in colored or tinted plastic with designs, patterns, figures or coins being cast into the cover for decorative purposes. When the night light is lit at a time that the toilet seat cover is down, it will then be very obvious that the solid lid stands out visibly against the lighted seat so that unmistakably a person will know that the seat cover must be lifted before the toilet seat can be used.

When the toilet seat is down and the light is lit, at no time does the bulb touch the toilet seat and therefore there is no chance of current flowing to the seat. By using a 12 volt system, which is low in amperage, as well as voltage, all danger of a serious electric shock is eliminated. When the toilet seat is raised and the lucite rod is removed from the hard rubber socket entrance, all electrical contacts are broken.

In use of the rheostat, it is preferred that the rheostat is attached directly at a wall socket, thereby using only approximately 16 gauge twin lead wire to the floor mounted bracket and to the light socket. Thus there would be no possibility of a person touching the water faucets or grounding himself by means of water and/or attempting adjustments of the rheostat to come into contact with 110 volts.

Thus there is provided a novel night light toilet seat.

While various changes may be made in the detailed construction, it is understood that such changes will be within the spirit and scope of the present invention as is defined by the appended claims.

What I now claim is:

1. In a night light toilet seat, the combination of a toilet seat member made of transparent resin or plastics, said toilet seat having hinged plates secured to a rear end thereof for pivoting said toilet seat member between an upwardly vertical, non-use position and a horizontal utility position, and means being provided whereby said toilet seat member is illuminated; said means comprising a clear lucite rod being cast within an interior of said toilet seat member, the opposite ends of said lucite rod extending outwardly of an underside of said toilet seat member and aligned with a light source means.

2. The combination as set forth in claim 1, wherein said light source means comprises an electric lamp contained within a hard rubber socket, said socket being mounted upon an upper end of a bracket standing upon a floor, and an upper edge of said socket having a rubber gasket thereupon for bearing against an underside of said toilet seat member.

3. The combination as set forth in claim 2, wherein said lamp is in an electrical circuit with a rheostat, transformer and a plug to an electric power source.

* * * * *